United States Patent [19]

Ohara

[11] 4,344,279

[45] Aug. 17, 1982

[54] HOLLOW STRINGS CONTAINING GELATINOUS OIL

[76] Inventor: Tamanosuke Ohara, 254 Yura Yuracho, Sumoto-city, Hyogo-Prefecture, Japan

[21] Appl. No.: 167,214

[22] Filed: Jul. 9, 1980

[30] Foreign Application Priority Data

Jul. 13, 1979 [JP] Japan ..... 54/89628

[51] Int. Cl.[3] ..... D02G 3/36; D01H 13/30; D02G 3/40; D02G 3/44

[52] U.S. Cl. ..... 57/232; 57/248; 57/258; 57/295

[58] Field of Search ..... 57/210, 200, 225, 232, 57/248, 250, 258, 6, 295

[56] References Cited

U.S. PATENT DOCUMENTS

| | | | |
|---|---|---|---|
| 3,465,618 | 9/1969 | McIntosh et al. | 57/248 X |
| 3,605,399 | 9/1971 | Rijswijk | 57/248 X |
| 3,745,061 | 7/1973 | Champaneria et al. | 57/248 X |
| 3,997,698 | 12/1976 | Lamberti | 57/258 X |
| 4,016,714 | 4/1977 | Titsworth | 57/258 X |
| 4,288,977 | 9/1981 | Csaky | 57/248 X |

FOREIGN PATENT DOCUMENTS 50-10054 3/1975 Japan .

*Primary Examiner*—Donald Watkins
*Attorney, Agent, or Firm*—Wenderoth, Lind & Ponack

[57] ABSTRACT

An improved hollow string comprising a hollow core containing gelatinous oil and a wrapping thread, which is used for rackets for ball games, such as tennis, squash, badminton, etc., and into the hollow cavity of which there is charged gelatinous oil of high viscosity which is in a state of gel at normal temperature and has a melting point of 30° C. or higher and fluidity at a temperature of 50° C. or higher.

4 Claims, 5 Drawing Figures

HOLLOW STRINGS CONTAINING GELATINOUS OIL

BACKGROUND OF THE INVENTION

The present invention relates to strings for use in rackets for ball games, for example, tennis, squash and badminton, which are hollowed and filled with gelatinous oil.

In conventional strings, as substitutes for natural strings made from sheep's intestines, there are widely used solid strings made of synthetic resins. These strings, however, are inferior to hollow strings in strength. Such defect may be ascribable to the fact that, in the manufacture of the synthetic resin monofilament forming a core of strings by molding, in case of elongating the core having desired diameter, a big difference between the central elongation distance (a)–(a') and the outer elongation distance (b)–(b'), as shown in FIG. 4, causes the difference in strain between the molecules of the resins. In this case, the thicker the core is, the bigger the difference in strain becomes, which causes lack of uniformity in the elongation of the core. In fact, for example, in the polyamide fiber used for cores, the strength of the thicker one is inferior to that of the thinner one. Compared with the solid core, in the hollow core, as shown in FIG. 3, non-uniform elongation can hardly be seen because only the circumferential portion of the core may be elongated independent of the central portion thereof, which is hollowed.

Each of solid strings and hollow strings are made by helically winding a wrapping thread about a solid core and a hollow core respectively. Thus, when each of the solid strings and the hollow strings are spread out on rackets with tension of 60–75 lb, a big difference becomes apparent in strength, durability and ball-striking touch.

Spreading of strings on rackets is usually effected by using a spreading machine under a fixed tension. In this case, when the hollow strings are spread as such, air is charged into the inner portion of the strings, which causes compression strain in the strings on striking balls resulting in lowering of bouncing force of the rackets.

For eliminating these drawbacks, there had been developed hollow strings into the hollowed inside of which liquid oil is charged (cf. Japanese Utility Model Registration No. 1106964). However, since this liquid oil has low viscosity and fluidity at normal temperature, for preventing the oil from flowing out, the string's end is required to be sealed with a stopper. In addition, when each string is cut in a desired length, upon spreading the strings on rackets, not only the oil flows out from the hollow of the strings to contaminate clothes or the like, but also air enters into said hollow of the strings to lower the bouncing force as described above.

SUMMARY OF THE INVENTION

For the purpose of eliminating such deflects, the present invention offers hollow strings comprising a hollow core containing gelatinous oil and a wrapping thread, characterized in that the hollow cavity of the core is charged with gelatinous oil having high viscosity which is in a state of gel or of ointment like grease at normal temperature and has almost no fluidity.

An essential object of the present invention is to provide an improved string for rackets which is excellent in strength and durability.

Another object of the present invention is to provide an improved string for rackets which is excellent in ball-striking touch when used for ball games.

A further object of the present invention is to provide an improved string for rackets, in which, in the manufacture of the string, by using gelatinous oil, it is easy to fill the hollow cavity of the string with said oil and it is possible to prevent the oil from flowing out of the string.

A still further object of the present invention is to provide an improved string for rackets which is colorful and attractive by previously coloring the gelatinous oil.

BRIEF DESCRIPTION OF THE DRAWINGS

These and other objects and features of the present invention will become apparent from the following description taken in conjunction with the preferred embodiment thereof with reference to the accompanying drawings in which.

DETAILED DESCRIPTION OF THE INVENTION

The present invention is explained according to the drawings, wherein 1 is a core comprising a synthetic resin monofilament, for example, polyamide monofilament. In the central portion of the core, there is provided a hollowed cavity 2 along the whole length of the core. Into the hollowed cavity 2 is charged gelatinous oil 3. The gelatinous oil 3 is of high viscosity with almost no fluidity and in a state of gel or ointment like grease at normal temperature (20° C.), and has a melting point of 30° C. or higher and a melting viscosity which falls at a temperature of 50° C. or higher to exhibit its fluidity. As such gelatinous oil, there are exemplified cyclic hydrocarbons having the formula: $C_nH_{2n-2}$, which are ointment-like substances having low melting points, such as petrolatum. This ointment-like substance is colorless or pale yellow.

When the gelatinous oil 3 is injected into the hollow cavity 2 of the core 1, said gelatinous oil is previously heated at 50° C. or higher to give fluidity thereto. After the completion of the injection, the unliquid oil is naturally cooled or may be forcibly cooled to lose the fluidity.

Figure 1:
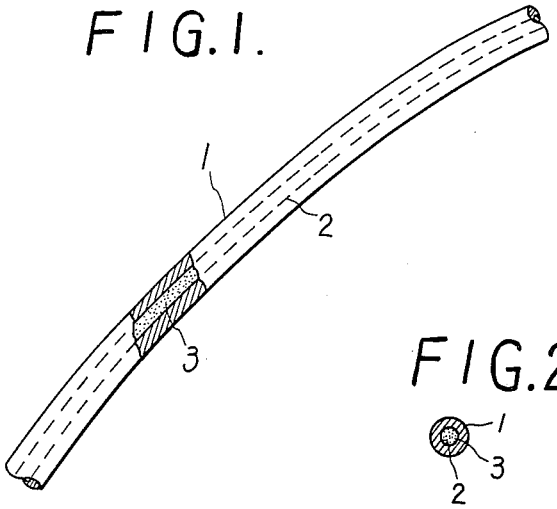
FIG. 1 is a perspective view showing, on an enlarged scale, a hollow core according to one preferred embodiment of the present invention.
Figure 2:
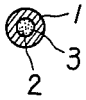
FIG. 2 is a sectional view of the hollow core of FIG. 1.
Figure 4:
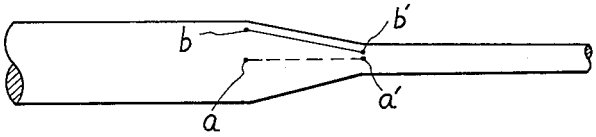
FIG. 3 and FIG. 4 are perspective views explanatory of a hollow core and a solid core, respectively, in a state of elongation thereof.
Figure 3:
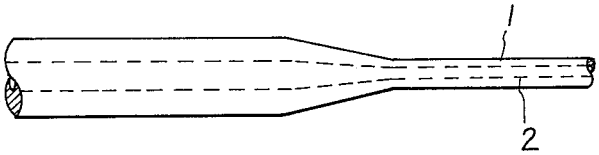
Figure 5:
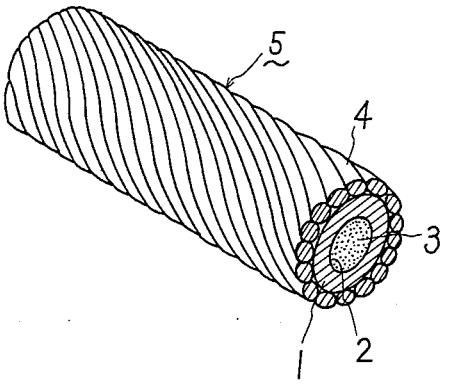
FIG. 5 is a perspective view showing, on an enlarged scale, a hollow string made by helically winding a wrapping thread about a core.

A wrapping thread 4 comprises, as shown in FIG. 5, one or more synthetic resin monofilaments, for example, polyamide monofilaments. Then a string 5 is made by winding helically the said wrapping thread 4 to the core 1 and by bonding them with a suitable adhesive. If two or more layers of the wrapping thread 4 are wound to the core 1, it is better to oppose the direction of winding of each layer.

Thus, in case of spreading the strings on rackets, even if the strings are cut in the desired length, the gelatinous oil never flows out from the cut end of the strings.

As described above, the present invention offers the hollow strings comprising a hollow core containing gelatinous oil and a wrapping thread, characterized in that, the gelatinous oil of high viscosity which is in a state of a gel at normal temperature and has a melting point of 30° C. or higher and fluidity at 50° C. or higher is charged into the hollow cavity. Accordingly the present hollow strings have the following advantages: the gelatinous oil is easily injected into the hollow cavity of the core by heating said gelatinous oil at 50° C. to 60° C., and after the completion of injection, the gelatinous oil almost loses its fluidity at normal temperatures maintaining high viscosity. Thus, in case of spreading the strings on rackets, even if they are cut in the desired length, there is no fear that the gelatinous oil will flow out from the cut end of the strings to contaminate clothes. In addition, since the hollowed portion of the strings which are spread on rackets is completely filled with the gelatinous oil, the ball-striking pressure, on the use of rackets, is conveyed through the whole gelatinous oil, and the bouncing force of the strings is remarkably improved due to uniform dispersion of the ball-striking force over the whole area of the longitudinal and lateral strings, whereby the return speed of the ball can be increased.

Further, in accordance with the weather of districts where the strings are used, for example, the cold latitudes or the subtropics, there may be employed petrolatum of an appropriate grade, taking into the consideration the melting point thereof corresponding to the temperature in the respective areas.

Furthermore, the present invention also provides colorful strings by previously coloring the gelatinous oil to be injected, the color of which can be seen through the material of strings.

What is claimed is:

1. A hollow string comprising a hollow core containing gelatinous oil and a wrapping thread helically wound thereabout, said hollow core being a hollow cavity through the central portion of said string, substantially along the whole length thereof and said gelatinous oil being a cyclic hydrocarbon of the formula $C_nH_{2n-2}$ and being of high viscosity with a melting point of 30° C. or higher and fluidity at a temperature of 50° C. or higher, said gelatinous oil exhibiting a gel-like consistency at normal temperature.

2. The hollow string according to claim 1, wherein both the hollow core and the wrapping thread are made of molded synthetic resin monofilament.

3. The hollow string according to claim 1, wherein both the hollow core and the wrapping thread are made of polyamide monofilament.

4. The hollow string according to claim 1, wherein the gelatinous oil is colored with a pigment.

* * * * *